United States Patent [19]

Troebel

[11] 4,211,907

[45] Jul. 8, 1980

[54] SETTING MECHANISM WITH DETENT STEPS FOR TRIPPING DEVICES OF ELECTRICAL SWITCH GEAR

[75] Inventor: Werner Troebel, Berlin, Fed. Rep. of Germany

[73] Assignee: Siemens Aktiengesellschaft, Berlin and Munich, Fed. Rep. of Germany

[21] Appl. No.: 7,558

[22] Filed: Jan. 29, 1979

[30] Foreign Application Priority Data

Feb. 3, 1978 [DE] Fed. Rep. of Germany ..... 2805181

[51] Int. Cl.[2] ..... H01H 9/20; H01H 37/22

[52] U.S. Cl. ..... 200/318; 335/176; 337/360

[58] Field of Search ..... 335/42, 45, 176; 337/77, 82, 129, 323, 360; 200/153 R, 318–328; 74/527

[56] References Cited

U.S. PATENT DOCUMENTS

| | | | |
|---|---|---|---|
| 2,920,161 | 1/1960 | Dessert et al. | 335/45 X |
| 3,758,887 | 9/1973 | Ellsworth et al. | 335/176 X |
| 3,831,120 | 8/1974 | Powell et al. | 335/176 |
| 3,975,701 | 8/1976 | Hendry et al. | 335/176 |

FOREIGN PATENT DOCUMENTS

| | | | |
|---|---|---|---|
| 1529259 | 6/1968 | France | 335/176 |

*Primary Examiner*—Stephen Marcus

*Attorney, Agent, or Firm*—Kenyon & Kenyon

[57] ABSTRACT

A setting mechanism for tripping devices of electrical switchgear has a driven inner member carrying a radially extending, resilient detent arm which interacts with stationary detent slots. For joining with an outer driving member, an interrupted ring snap-in connection is provided between the inner and outer elements which is designed so that eccentric forces as well as asymmetrical spreading forces caused by the resilient detent arm and by the application of torque can be transmitted. For this purpose, two larger posts lying one behind the other on the longitudinal axis of the detent arm have right-angled undercuts and two smaller posts disposed between the first posts are provided with radial projections. The projections have side walls lying in planes extending parallel to the longitudinal axis of the setting mechanism. The setting mechanism members are made as complete parts by injection molding of plastic material.

7 Claims, 12 Drawing Figures

SETTING MECHANISM WITH DETENT STEPS FOR TRIPPING DEVICES OF ELECTRICAL SWITCH GEAR

BACKGROUND OF THE INVENTION (a) Field of the Invention

The present invention relates to a setting mechanism with detent steps for tripping devices of electrical switchgear. More particularly, it relates to low-voltage circuit breakers having an insulating material housing and a setting member accessible on the outside of the switching device and having an inner portion which includes a bearing part for rotatably supporting the setting member.

(b) Discussion of the Prior Art

Setting mechanisms of this type have been described, for instance, in British Pat. No. 1,400,039 and U.S. Pat. No. 3,831,120. There, the purpose of setting the thermal or magnetic tripping devices of switches to release at a given current level is accomplished by turning an outer setting member. The force applied is transmitted to an inner element which moves parts belonging to the tripping devices, such as magnet armatures, setting members for bimetallic strips or the like, where, in general, restoring forces must be overcome. Once selected, the setting should not change by itself under the forces experienced in ordinary operation. A detent system is provided as part of the setting device which must, therefore, be capable of withstanding the restoring forces of the internal parts of the tripping devices as well as external, operation-related forces. To meet these requirements, present setting mechanisms provide components corresponding in number to the steps required. In this connection, the setting mechanism of German Auslegeschrift 10 67 514 provides a further example. There, an outer part of a setting element is mounted on a round shaft which, in turn, is held in bearing parts. The inner portion of the setting member consists of an eccentric which is mounted on an eccentric shoulder of the outer setting meber. A lever fastened on the round shaft is provided for detenting the outer setting or driving member, being forced by a spring against the bearing part of the housing. The lever has a detent edge which engages detent slots on the inside of the outer setting member.

Ring snap-in connections for the assembly of parts are known in the art, being used for connecting machine parts and in precision mechanics. (Journal "Konstruktion", 29, 1977, No. 10, pp. 387–397; Journal "Verbindunstechnik", No. 7/8, 1977, pp. 29–33.)

It is an object of the invention to reduce the number of parts required for the manufacture of setting devices of the type described, and, at the same time, the space required.

SUMMARY OF THE INVENTION

In accordance with the teachings of the present invention, the setting mechanism need consist of only two parts which are brought into engagement with each other by axial pressure applied when they are in the proper position. this is accomplished with the aid of a ring snap-in joint. The assembled ring takes up both axial forces and asymmetrical forces exerted by the detect arm in addition to any torque.

For connecting the parts in the snap-in joint, it is advantageous to provide two posts extending from one part into engagement with the other, the posts being undercut with sharp corners at right angles to the longitudinal axis of the setting members, and to position them on the extension of the longitudinal axis of the detent arm. Between these posts two additional posts are provided which have radially protruding projections. The posts having the undercuts engage a major portion of the circular circumference of the ring snap-in connection and the posts having the projections, the smaller portion. The posts having the undercuts provide support against the asymmetrical force stemming from the detent arm.

The projections, which in the arrangement mentioned above are arranged approximately on a line perpendicular to the extension of the longitudinal axis of the detent arm, are provided with flanks which lie in planes parallel to the longitudinal axis of the ring snap-in connection. Positive, secure transmission of torque and an increase in the strength of the ring snap-in connection against separation due to the asymmetrically directed force of the detent arm are thereby achieved.

It is a feature of the invention that the upper part or case of the switching housing may serve as a bearing part for the ring assembly. The bearing part is provided with detent slots surrounding the bearing opening. Additional elements for the detent steps are thus unnecessary.

The detent arm of the driven member is made with a built in curvature or bias at the time of fabrication, so that, when the setting members are assembled, a detent edge of the detent arm engages, approximately parallel, in the detent slots with the desired amount of pretension. The detent force is thus produced automatically when the setting mechanism is assembled.

The inner setting member is also provided with an eccentric extension in the form of a pin, a cam, or the like, which cooperates directly with a setting element of a tripping device. This arrangement is space-saving as well as accurate with respect to the establishment of definite tripping values.

The setting organs can be made of suitable plastic materials by known processing methods. Good results are obtained, for instance, with polyamides or terephthalates.

DETAILED DESCRIPTION OF THE INVENTION

Figure 1:
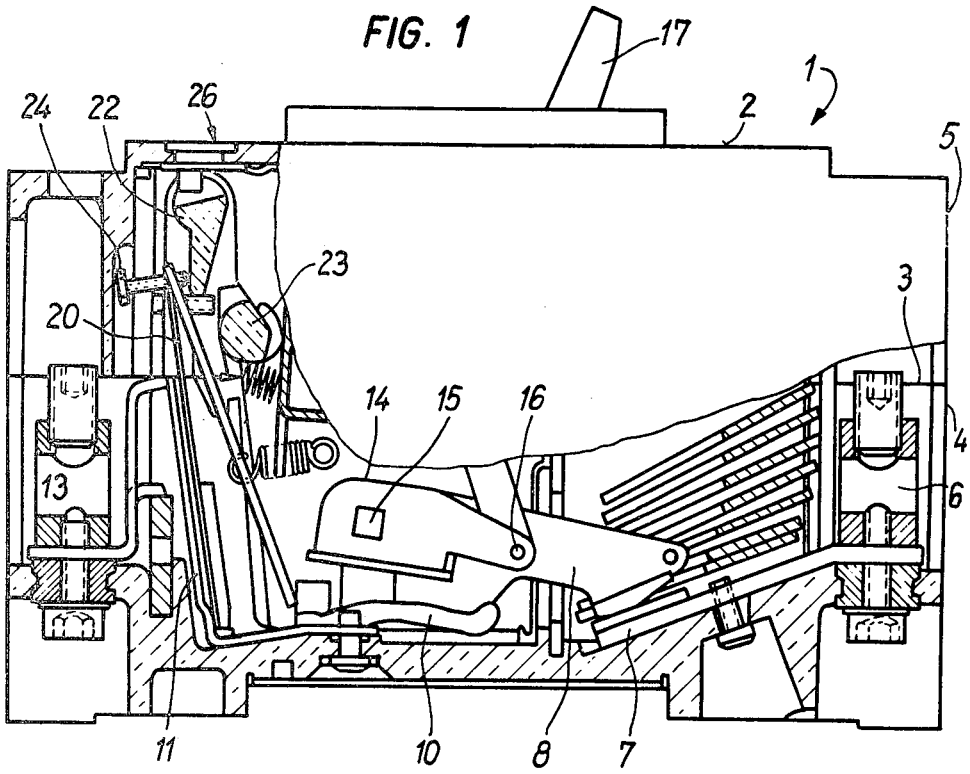
FIG. 1 is a side view in partial cross-section, of a low-voltage circuit breaker embodying the teachings of the invention.

The low voltage circuit breaker 1, shown partly in cross-section in the side view of FIG. 1, has a housing 2 of insulating material which is divided along parting line 3 into lower and upper parts 4 and 5, respectively. Current flowing through the breaker starts at terminal 6 and flows via fixed contact 7 through movable contact 8, flexible conduct 10, and heater conductor 11 to another terminal 13. The contact 8 can be moved by means of a contact carrier 14 which is actuated, by control shaft 15 for switching on and off. Control shaft 15 interconnects the several contact carriers 14 (not shown) of the parallel current paths of the low-voltage circuit breaker 1. Driving force is transmitted, by a mechanism well known in the art and, therefore, not illustrated, to joint pin 16 which connects movable 8 to contact carrier 14, the drive mechanism being engaged to the joint pin 16 of the middle pole of low voltage circuit breaker 1.

Operating handle 17 serves for switching on and off manually; it protrudes through an opening in upper part 5 of housing 2. For automatically opening low-voltage circuit breaker 1, a variety of thermal and magnetic tripping devices may be provided, which are of a kind well known in the art. In FIG. 1, an example of a thermal tripping device is shown. The essential parts of this comprise a bimetallic strip 20, which can be heated by a heater element 11, a setting member 22, which can be displaced perpendicularly to the plane of the drawings; and a tripping shaft 23. The distance of setting member 22 from adjusting screws 24 and an inclined lever arm (not visible in FIG. 2) of tripping shaft 23 and, thereby, the tripping current, can be varied by setting mechanism 26, the structure of which will now be explained in detail.

Figure 2:
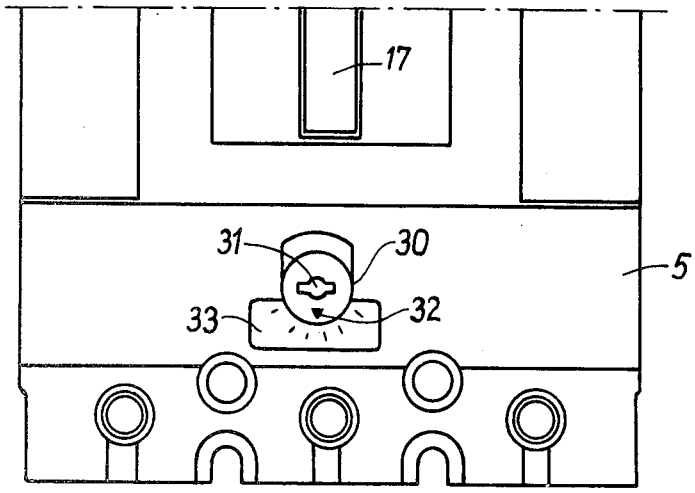
FIG. 2 is a top view of a portion of the circuit breaker of FIG. 1 showing the driving portion of the setting element.

As can be seen in FIG. 2, outer driving member 30 is arranged on the outer surface of upper part 5 of insulating material housing 2 below operating handle 17. This outer setting member 30 has a slot 31 for insertion of a suitable tool, e.g., a screwdriver, and is provided with a mark 32, associated with which a scale 33 having divisions for given tripping current levels. Drive member 30 can turn an inner, driven member which acts on setting member 22 of FIG. 1.

Figure 3:
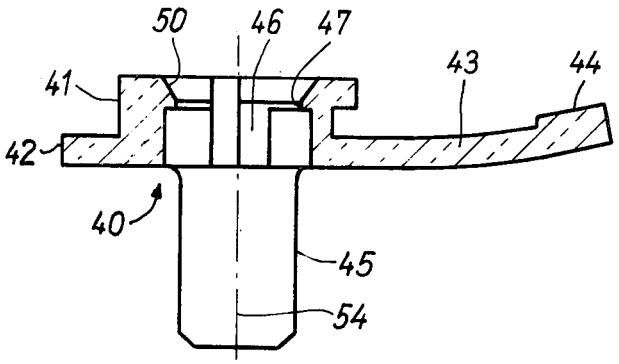
FIG. 3 is a view in cross-section of the inner portion of a setting element.
Figure 4:
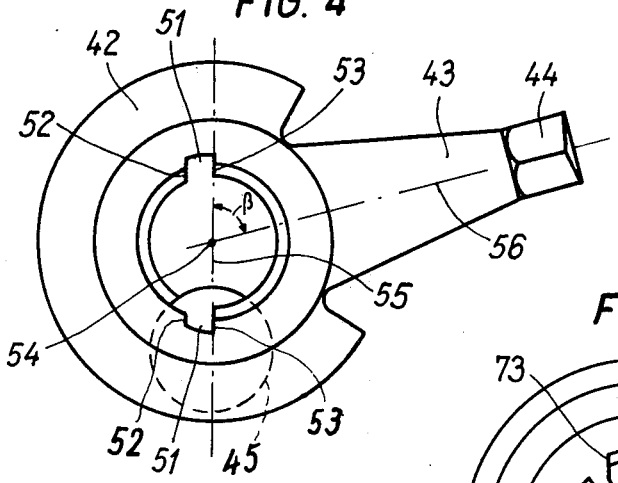
FIG. 4 shows a top view of inner, or driven portion of the setting element shown in FIG. 3.

An embodiment of inner setting member 40 is shown in FIGS. 3 and 4. Inner setting member 40, which is injection molded of a suitable plastic material, has a cylindrical neck part 41, which serves for rotatably supporting the setting mechanism in a corresponding opening in upper part 5 of housing 2. To make contact with the front surface housing wall, an additional, flange-like cylindrical section 42 is provided which extends around about $\frac{3}{4}$ of the circumference of neck part 41. In the gap remaining, flange 42 becomes a detent arm 43 whose end is provided with a roof-like detent edge 44. As can be seen in FIG. 3, detent arm 43 itself is curved upward so as to force the detent edge 44 into contact with detent slots on the inside housing surface under pre-tension, when cylindrical section 42 rests against the inner housing wall. For operating the setting member of a tripping device, inner setting element 40 is provided with pin 45, eccentrically disposed relative to the axis of the element. The central opening 46 of the setting member 40 is undercut with sharp right angled corners, leaving a lip or projection 47; it then expands upward and outwards with a conical mouth 50. Opening 46 is enlarged by two formed in recesses 51 disposed on opposite sides of the axis and having parallel side walls 52 and 53. Side walls 53 lie in a plane 55 which passes through the longitudinal axis 54 of opening 46.

As can be seen in FIG. 4 the plane 55 and the longitudinal axis 56 of detent arm 43 are offset from 90°, being at an angle. The small asymmetry resulting in unimportant, however, to the operation of the ring snap-in connection.

Figure 5:
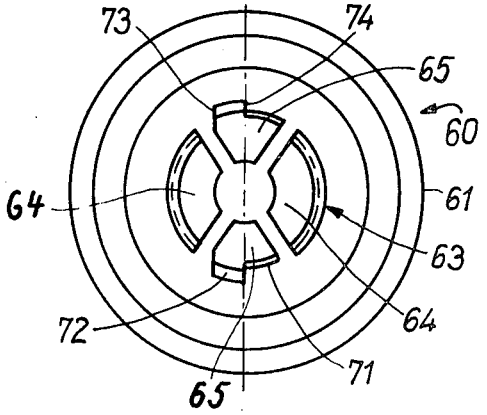
FIG. 5 is a bottom view of the outer, driving portion of the setting element.
Figure 6:
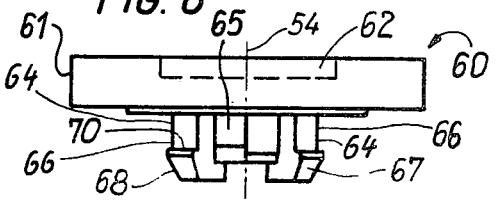
FIG. 6 is a side view of the driving portion of FIG. 5.
Figure 7:
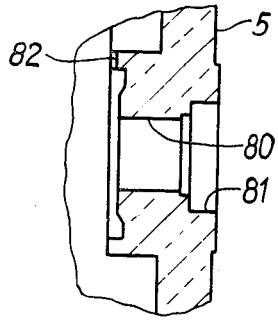
FIG. 7 is a view in cross-section of a portion of the upper part of the housing in the vicinity of the setting mechanism.

A driving or outer member 60 which mates and interacts with inner member 40 to form setting element 26 is shown in FIGS. 5 and 6. This outer setting member comprises a flat cylindrical part 61 having slot 62 adapted to receive a suitable tool, e.g., a screw-driver. On the side of the ring snap-in connection facing away from the slot, there is a projecting part 63 which is "interrupted" to provide two opositely disposed posts 64 and two other, differently shaped, posts 65. Posts 64 each extend over about 110°, while posts 64 occupy about 70° of the circumference of part 63. Posts 64 each have a mushroom-like profile resulting from a base part 66 emerging perpendicularly from the surface of flat cylindrical part 61 and a head part 67 enlarged and chamfered to form conical outside surface 68. The outside diameter of outside surface 68 is larger than that of base part 66, the transition being made by a step 70 projecting at right angles and having sharp corners.

Each of the smaller posts 65 each has, extending over one-half of its dimension along the circumference, an end section 71 whose outside diameter corresponds to the diameter of base part 66 of larger posts 64. Over the other half of the circumference, each of the ends of posts 65 is occupied by a projection 72 having parallel side walls or flanks 73 and 74. Side walls 74 lie in a plane which passes through the longitudinal axis (as best seen in FIG. 6) of the ring snap-in connection. FIG. 6 also shows that the posts 65 are shorter than the posts 64, extending to about the level of steps 70.

The driven member 40 and driving member 60 are assembled by pressing them together. In this process, the conical outside surfaces 68 of posts 64 first enter conical mouth 50 of driven member 40, centering both parts relative to each other. Due to the springiness of base parts 66 of posts 64 of outer element 60, the ends of posts 64 pass through and then engage, with their steps 70 hooking behind projections 47 of inner member 40. Except for the small offset angle mentioned above, posts 64 then lie one behind the other along the longitudinal axis 56 of detent arm 43. Because of the sharp cornered fit of the two parts, any asymmetrical spreading forces exerted by detent arm 43 on the ring snap in connection are easily taken up. The transmission of torque from outer setting element 60 to detent arm 43 and eccentric post 45 is made possible by the large area contact between flanks 73 and 74 of the shorter posts 65 with the likewise parallel flanks 52 and 53 of recesses 51 of inner setting element 40.

The assembled structure consisting of outer and inner setting elements is supported by means of the cylindrical neck part 41 of inner element 40 which is received in an appropriately configured, mating bore hole 80 in upper part 5 of insulating housing 2. As shown in FIG.

7, hole 80 terminates on the outside surface of the housing in a cylindrical enlargement or recess 81 which conformably receives the cylindrical upper part of driving member 60. On the inside surface of upper part 5, the hole 80 is surrounded at a distance by a ring of detent slots 82, with which ridge 44 formed on the end of detent arm 43 interacts. Depending on whether the tripping devices of the individual poles are to be adjustable individually or jointly, the described arrangement can be provided once or in multiple.

Figure 8:
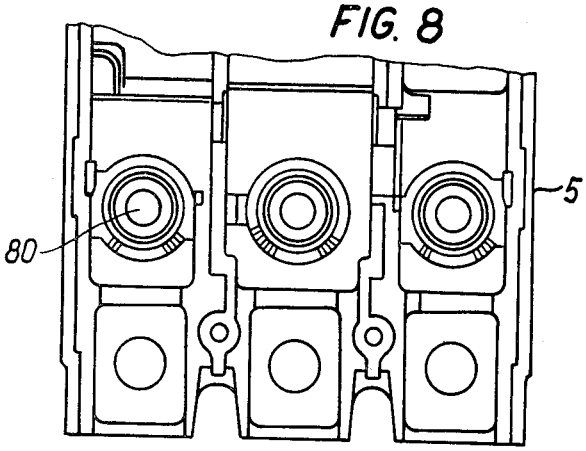
FIG. 8 is an inside view of a portion of the upper part of the housing, showing the openings for the setting mechanisms of a low voltage circuit breaker.

FIG. 2 shows the use of a single setting device operating the setting mechanism of a circuit breaker in common. FIG. 8 shows a portion of a breaker housing in which three holes 80 are provided for side by side setting mechanisms.

Figure 9:
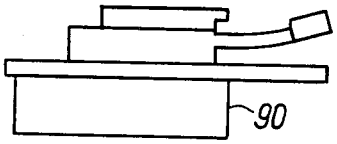
FIG. 9 is an inside view of an alternative embodiment of an driven member of a setting element in accordance with the teachings of the invention.
Figure 10:
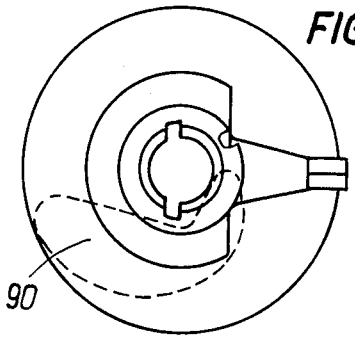
FIG. 10 is a top view of the embodiment of FIG. 9.

In the example of FIGS. 3 and 4, the driving member 40 is provided with an eccentric pin 45 for connection with the tripping mechanism. FIGS. 9 and 10 show the use of an eccentric cam 90 which can be provided instead.

It is possible, depending on the requirements, to combine differently designed inner setting members with complementary driving members. Conversely, outer members differing, for instance, in the size and shape of the part accessible from the outside, can be used with the same inner members. The described parts can also be used for housings having a different wall thickness as it is only necessary to provide neck parts of different length on the inner setting members.

Figure 11:
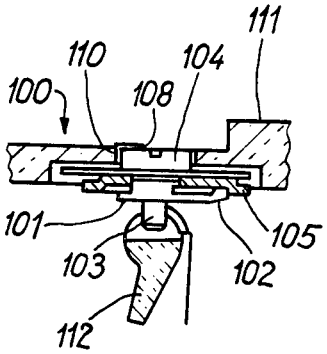
FIG. 11 is a view in cross-section of a setting mechanism having a separate bearing part.
Figure 12:
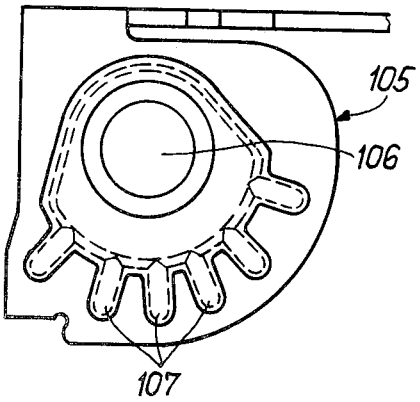
FIG. 12 is a plan view of the separate bearing part of FIG. 11.

The embodiment of FIG. 11 shows a setting mechanism 100 which comprises an inner setting member 101 having a radially extending detent arm 102, and eccentric post 103 and outer setting member 104; it is supported in a separate bearing part 105, which can be part of a side plate of the breaker. The bearing part 105, which is shown enlarged in the top view of FIG. 12, has a bearing opening 106 and detent slots 107 in which detent arm 102 engages its detent edge.

A loose fit, giving a certain amount of play, is provided between head part 108 of driving member 104 and the opening 110 into which it passes in insulating housing 111, in order to make possible a relative displacement between the setting mechanism and insulating housing 111. This arrangement is advantageous when it is important to maintain close tolerances between the setting mechanism and a cooperating setting member 112 of a tripping device. Since this setting member can also be supported on bearing part 105, a fixed spatial relationship between setting member 112 and eccentric pin 103 of inner setting organ 101 can be provided.

What is claimed is:

1. A setting mechanism with detent stops for use in a tripping device of a low voltage circuit breaker having a housing of insulating material comprising:

an outer setting member which is accessible from outside the breaker, and an inner setting member connected to the outer setting member by means of an interrupted snap-in ring to form a shaft for supporting both members in a bearing part, the inner setting member carrying an essentially radially extending detent arm which is resilient perpendicular to its longitudinal axis in the direction of the upper part of the bearing part, and the outer setting member having a radially resilient post which is undercut with sharp corners for engaging the ring and a second post having an approximately radial protrusion for engaging a corresponding recess in the inner setting member.

2. A setting mechanism in accordance with claim 1 further comprising two resilient posts being provided on the outer setting organ which are undercut at right angles to the longitudinal axis of the setting element and have sharp corners for engaging the ring and two further posts being disposed between the resilient posts on the extension of the longitudinal axis of the detent arm which have approximately radially protruding projections.

3. A setting mechanism in accordance with claim 2 in which the posts which are undercut with sharp corners have widths which, taken together, extend over the larger portion of the circumference of the ring snap-in connection, and the posts which have projections extend over the smaller portion of the circumference.

4. A setting mechanism in accordance with claim 3, in which the projections have side walls lying in planes extending parallel to the longitudinal axis of the ring snap-in connection.

5. A setting mechanism in accordance with claim 1 in which the bearing part supporting the setting members is provided with detent slots adjacent to the bearing opening.

6. A setting mechanism in accordance with claim 5 in which the detent arm has built-in resilience for forcing a detent edge on the detent arm into engagement with the detent slots on the bearing part when the setting members are joined together.

7. A setting mechanism in accordance with claim 1 further comprising the inner setting member being adapted to interact directly with the setting element of a tripping device.

* * * * *